US008602915B2

(12) United States Patent
Oldknow

(10) Patent No.: US 8,602,915 B2
(45) Date of Patent: Dec. 10, 2013

(54) GOLF BALL WITH CHANGEABLE DIMPLES

(75) Inventor: Andrew G. V. Oldknow, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 428 days.

(21) Appl. No.: 12/916,955

(22) Filed: Nov. 1, 2010

(65) Prior Publication Data

US 2012/0108361 A1 May 3, 2012

(51) Int. Cl.
*A63B 37/14* (2006.01)
*A63B 37/12* (2006.01)

(52) U.S. Cl.
USPC ..... 473/378; 473/383

(58) Field of Classification Search
None
See application file for complete search history.

(56) References Cited

U.S. PATENT DOCUMENTS

| | | | | |
|---|---|---|---|---|
| 4,073,983 | A | 2/1978 | Van Cleave | |
| 4,660,834 | A * | 4/1987 | Carrigan | 473/165 |
| 5,040,795 | A * | 8/1991 | Sonntag | 473/596 |
| 5,266,669 | A | 11/1993 | Onwunaka et al. | |
| 5,334,691 | A | 8/1994 | Gould et al. | |
| 5,816,943 | A * | 10/1998 | Masutani et al. | 473/365 |
| 5,823,891 | A | 10/1998 | Winskowicz | |
| 5,938,544 | A | 8/1999 | Winskowicz | |
| 5,962,620 | A | 10/1999 | Reich et al. | |
| 5,975,869 | A | 11/1999 | Shimosaka et al. | |
| 6,017,625 | A | 1/2000 | Sato et al. | |
| 6,277,037 | B1 | 8/2001 | Winskowicz et al. | |
| 6,308,623 | B1 * | 10/2001 | Schonberger et al. | 101/352.13 |
| 6,358,160 | B1 | 3/2002 | Winskowicz | |
| 6,450,901 | B1 | 9/2002 | Binette et al. | |
| 6,610,382 | B1 | 8/2003 | Kobe et al. | |
| 6,645,099 | B2 | 11/2003 | Gaff et al. | |
| 6,776,731 | B2 * | 8/2004 | Shannon et al. | 473/384 |
| 6,787,487 | B1 | 9/2004 | Takeda et al. | |
| 6,794,027 | B1 | 9/2004 | Araki | |
| 6,811,497 | B1 | 11/2004 | Jones et al. | |
| 6,893,360 | B2 | 5/2005 | Brown | |
| 7,244,193 | B2 * | 7/2007 | Emalfarb | 473/351 |
| 7,427,243 | B2 | 9/2008 | Sullivan | |

(Continued)

FOREIGN PATENT DOCUMENTS

| | | |
|---|---|---|
| CN | ZL201120217159.0 | 5/2012 |
| CN | ZL201120426008.6 | 12/2012 |

(Continued)

OTHER PUBLICATIONS

Extended European Search Report dated Jan. 12, 2012 in European Patent Application No. EP 11187258.6.

(Continued)

*Primary Examiner* — Gene Kim
*Assistant Examiner* — John E Simms, Jr.
(74) *Attorney, Agent, or Firm* — Plumsea Law Group, LLC

(57) ABSTRACT

This disclosure provides a golf ball that is configured to be capable of changing its dimple depth. Changing the dimple depth of at least one of the plurality of dimples affects the aerodynamic properties of the golf ball, such that the play characteristics of the golf ball can be customized. The golf ball may be changed from a first configuration having deeper dimples to a second configuration having shallower dimples. Also provided is a method of customizing a golf ball, the method including the steps of possessing a golf ball that is in accordance with this disclosure and then inducing a mutable portion of the golf ball's cover layer to change the dimple depth.

21 Claims, 11 Drawing Sheets

(56) References Cited

U.S. PATENT DOCUMENTS

| | | | | |
|---|---|---|---|---|
| 7,484,735 | B2 * | 2/2009 | Verbrugge et al. | 277/628 |
| 7,549,936 | B2 * | 6/2009 | Ladd et al. | 473/373 |
| 7,601,079 | B2 | 10/2009 | Sullivan | |
| 8,393,979 | B2 * | 3/2013 | Fitchett | 473/378 |
| 2003/0104880 | A1 * | 6/2003 | Fushihara | 473/378 |
| 2003/0232666 | A1 | 12/2003 | Sullivan | |
| 2004/0224792 | A1 * | 11/2004 | Brown | 473/378 |
| 2005/0227789 | A1 | 10/2005 | Winskowicz et al. | |
| 2005/0250603 | A1 * | 11/2005 | Kennedy et al. | 473/371 |
| 2005/0269737 | A1 | 12/2005 | Hogge et al. | |
| 2006/0223654 | A1 * | 10/2006 | Kennedy et al. | 473/371 |
| 2006/0276265 | A1 | 12/2006 | Sullivan | |
| 2007/0117662 | A1 | 5/2007 | Ma | |
| 2007/0155542 | A1 | 7/2007 | Sullivan et al. | |
| 2007/0213143 | A1 * | 9/2007 | Chinn et al. | 473/351 |
| 2008/0081710 | A1 * | 4/2008 | Chen et al. | 473/373 |
| 2008/0220907 | A1 | 9/2008 | Aoyama et al. | |
| 2009/0023516 | A1 | 1/2009 | Rajagopalan et al. | |
| 2009/0221386 | A1 * | 9/2009 | Ladd et al. | 473/374 |
| 2009/0291120 | A1 | 11/2009 | Tuominen et al. | |
| 2011/0177884 | A1 | 7/2011 | Ichikawa et al. | |
| 2011/0319197 | A1 * | 12/2011 | Fitchett | 473/378 |
| 2012/0165129 | A1 * | 6/2012 | Maxwell et al. | 473/383 |

FOREIGN PATENT DOCUMENTS

| | | |
|---|---|---|
| DE | 4408615 | 9/1995 |
| DE | 202004014864 | 2/2005 |
| EP | 2347799 | 7/2011 |
| EP | 2353665 | 11/2011 |
| EP | 2446939 | 5/2013 |
| JP | 2002102388 | 4/2002 |
| JP | 2007260317 | 10/2007 |

OTHER PUBLICATIONS

Notification of Grant of Patent Right for Utiltiy Model issued on Jan. 10, 2013 for Chinese Utility Model Patent Application No. 201220304162.0.

Office Action for U.S. Appl. No. 12/822,470, mailed on Apr. 3, 2012.

Communication under Rule 71(3) EPC in European Patent application No. EP11187258.6, mailed on Nov. 21, 2012.

Final Office Action in U.S. Appl. No. 12/822,470, mailed on Jul. 30, 2012.

Notice of Allowance in U.S. Appl. No. 12/822,470, mailed on Nov. 9, 2012.

Notification of Grant of Patent Right for Utility Model in Chinese Utility Patent Application No. 201120426008.6, mailed on Jul. 25, 2012.

Notification of Grant of Patent Right for Utility Model in Chinese Utility Patent Application No. 201220304162.0, mailed on Jan. 10, 2013.

Communication pursuant to Rules 70(2) and 70a(2) EPC and reference to Rule 39(1) EPC mailed May 7, 2012 for European Patent Application No. 11187258.6.

Response to Communication pursuant to Rules 70(2) and 70a(2) EPC and reference to Rule 39(1) EPC mailed May 7, 2012 for European Patent Application No. 11187258.6 as filed on Jul. 6, 2012.

Notification of Grant of Patent Right for Utility Model issued Jan. 10, 2011 for Chinese Utility Model Patent Application No. 201120217159.0.

Communication under Rule 71(3) EPC mailed Dec. 7, 2012 for European Patent Application No. 11169806.4.

European Search Report dated Nov. 4, 2011 in European Patent Application No. 11169806.4.

Notification of First Office Action issued Apr. 26, 2012 for Chinese Utility Model Patent Application No. 201120426008.6.

* cited by examiner

GOLF BALL WITH CHANGEABLE DIMPLES

BACKGROUND

The present disclosure relates generally to the field of golf balls. Specifically, the present disclosure relates to a golf ball having at least one dimple, where the dimple is capable of changing in such a way as to alter the play characteristics of the golf ball.

The game of golf is an increasingly popular sport at both the amateur and professional levels. A wide range of technologies related to the manufacture and design of golf balls are known in the art. Such technologies have resulted in golf balls with a variety of play characteristics. For example, different golf balls are manufactured and marketed to players having different golfing abilities, such as different swing speeds.

Similarly, a golfer may use different golf balls having different play characteristics depending on, for example, the golfer's preferences or the play conditions. For example, different dimple characteristics may affect the aerodynamic properties of the golf ball during flight, or a difference in the hardness of the cover layer may affect the rate of backspin. With regard to the dimples in particular, a wide variety of dimple characteristics are known to affect the golf ball's aerodynamic properties, such as the dimple pattern, dimple shape and dimple depth.

Ideally, the dimples should be designed to achieve the greatest possible flight distance by achieving reduced drag and increased lift. As is generally known, drag is the air resistance that opposes the golf ball's flight direction. Drag is caused by the difference between high air pressure in front of the golf ball and low air pressure in the golf ball's wake. The dimples cause a thin boundary layer of air bordering the golf ball's outer surface to flow in a turbulent manner. The turbulent boundary layer moves the separation point backward, so that the boundary layer stays adjacent to the golf ball further along the ball's outer surface. As a result, the area of the wake is reduced and the pressure behind the ball is increased. Drag is thereby reduced, and the golf ball achieves increased flight distance.

As is also generally known, lift is an upward force on the golf ball that is created by a difference in pressure between the top of the ball and the bottom of the ball. Due to the golf ball's backspin, the top of the ball moves in the same direction as the airflow, which moves the air separation point to a location further backward. Conversely, the bottom of the ball moves against the airflow, which moves the separation point forward. This asymmetrical separation creates an arch in the flow pattern, whereby air that flows over the top of the ball moves faster than the air that flows along the bottom of the ball. As a result, the air above the ball is at a lower pressure than the air underneath the ball. This pressure difference results in the overall force, lift, which is exerted upwardly on the ball. Lift therefore causes the golf ball to achieve increase flight distance, as the upward lift force keeps the golf ball in the air for a longer period of time.

Dimple depth in particular can significantly affect the aerodynamics of the golf ball's flight. As is generally known, shallower dimples tends to result in the golf ball rising higher during flight. Conversely, the deeper the golf ball dimples, the lower the golf ball flight. It is believed that these tendencies are caused by decreased lift due to greater turbulence of the air inside deeper dimples, although many different aerodynamic phenomenon likely come into play.

Consequently, a golfer may desire to use a golf ball having shallow dimples or a golf ball having deeper dimples at different times, depending on a variety of factors. For example, the weather, the golfer's athletic abilities, the amount of back spin applied, and the particulars of the equipment being used may all affect whether shallow dimples or deeper dimples will better achieve the greatest total flight distance. Specifically, for example, a golfer may prefer to use a golf ball with deep dimples under high wind conditions, because such a golf ball will fly lower to the ground and therefore not be as affected by the wind. On the other hand, a golf may prefer to use a golf ball with shallow dimples under low winds conditions, in order to achieve a slightly increased total flight distance, all other factors being equal.

Amateur golfers generally prefer to minimize the costs of purchasing new golf balls. However, a golfer may be required to purchase several sets of golf balls in order to achieve different play characteristics. Namely, a golfer may be required to purchase one set of golf balls with shallow dimples and another separate set of golf balls with deeper dimples. The need to purchase, store and carry several sets of golf balls in order to achieve a variety of play characteristics presents an inconvenience to the golfer, as well as increased costs.

Therefore, there is a need in the art for a system and method that addresses the shortcomings of the prior art discussed above.

SUMMARY

In one aspect, the present disclosure provides a golf ball comprising: a core; an intermediate layer substantially surrounding the core; and an outer layer, the outer layer including a plurality of dimples and at least one land area separating the dimples, each of the plurality of dimples including a base area defined by a bottom surface of the dimple; wherein the outer layer substantially surrounds the intermediate layer, such that the outer layer overlays the entirety of the intermediate layer except at the base area of each of the plurality of dimples; wherein the intermediate layer is configured to be capable of changing from a first configuration to a second configuration; and wherein the first configuration is associated with a first dimple depth, the second configuration is associated with a second dimple depth, the second dimple depth being different from the first dimple depth.

In another aspect the present disclosure provides A golf ball comprising: a core; a cover layer substantially surrounding the core; the cover layer including at least one dimple having a dimple volume, and at least one land area adjacent to the dimple; wherein at least the land area is comprised of a relatively non-mutable material, and at least a bottom surface of the dimple is comprised of a relatively mutable material; and wherein a physical change in the relatively mutable material alters the dimple volume.

In yet another aspect, the present disclosure provides a method of customizing a golf ball, the method comprising: (1) possessing a golf ball, the golf ball including a core, and a cover layer substantially surrounding the core; the cover layer including a plurality of dimples and at least one land area separating the dimples; the cover layer further including a mutable portion configured in a first configuration, the first configuration being associated with a first dimple depth; and (2) inducing the mutable portion to change from the first configuration into a second configuration, the second configuration being associated with a second dimple depth, wherein the second dimple depth is different from the first dimple depth.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Generally, the present disclosure relates to a golf ball wherein at least one of the dimples is changeable in such a manner as to affect the play characteristics of the golf ball. Specifically, at least one of the dimples is configured to be capable of changing from a relatively deeper dimple depth to a relatively shallow dimple depth, so that a golfer can customize the aerodynamic properties of the golf ball in order to achieve a desired flight path.

Figure 1:
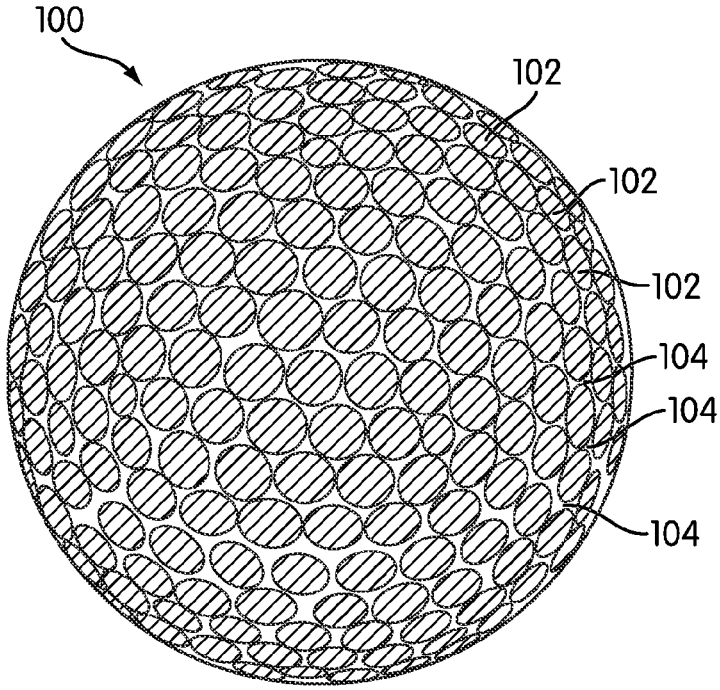
FIG. 1 shows a golf ball having a plurality of dimples and a land area separating the dimples.

FIG. 1 shows an embodiment of the present disclosure in golf ball 100. Golf ball 100 includes a plurality of dimples 102 and a land area 104 separating the dimples on the surface thereof. Except as otherwise discussed herein below, golf ball 100 may generally be any type of golf ball known in the art. Namely, unless the present disclosure indicates to the contrary, golf ball 100 may generally be of any construction conventionally used for golf balls, and may be made of any of the various materials known to be used in golf ball construction.

Figure 2:
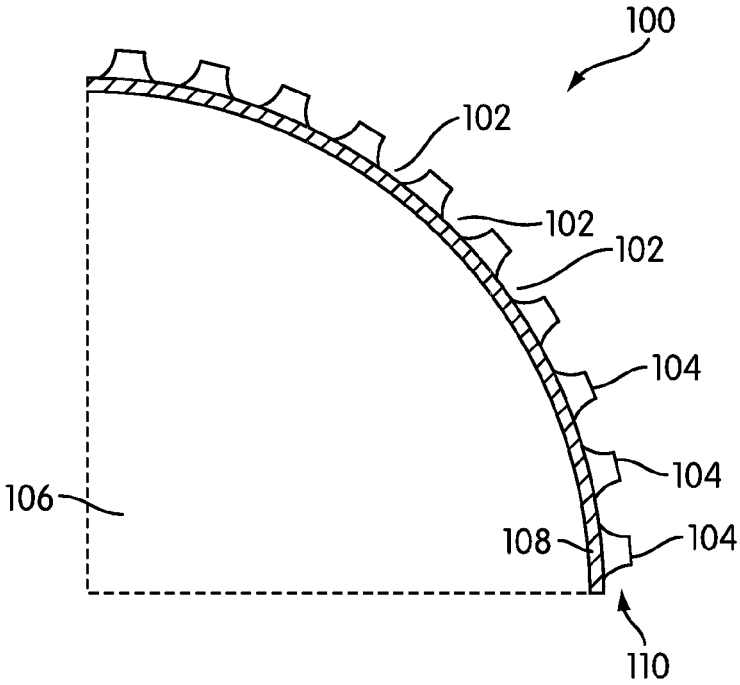
FIG. 2 shows a cross-sectional view of a quarter-turn of the golf ball of FIG. 1.

FIG. 2 shows a cross-sectional view of one-quarter of golf ball 100. In FIG. 2 three distinct parts of golf ball 100 are shown. A core 106 makes up the center of golf ball 100, an intermediate layer 108 substantially surrounds core 106, and outer layer 110 overlays intermediate layer 108 as shown. Although only these three components of golf ball 106 are shown in FIG. 2, golf ball 100 may include additional layers not shown. Such additional layers may include, for example, one or more additional inner layers between core 106 and intermediate layer 108, or one or more additional finishing layers on top of intermediate layer 110 and/or outer layer 104. Finishing layers may include, for example, clear coating layers, cosmetic marking layers, or other layers.

As is shown in FIG. 2, outer layer 110 includes a plurality of dimples 102 and at least one land area 104 separating the dimples thereon. Each of the plurality of dimples 102 includes a base area defined by a bottom surface of the dimple 102. Outer layer 110 substantially surrounds intermediate layer 108 as shown, such that outer layer 110 does not overlay the base area of each dimple 102. This feature is further shown in FIG. 3, discussed below.

As used herein, the term "cover layer" may be understood as the outermost structural layers of a golf ball, not including any relatively thin finishing layers. In the embodiment of FIG. 2, outer layer 110 and intermediate layer 108 may collectively be referred to as the cover layer, as outer layer 110 is the outermost structural layer at land areas 104 while intermediate layer is the outermost structural layer at the bottom surface of each dimple 102. Broadly speaking, therefore, golf ball 100 includes core 106 and a cover layer (collectively made up of intermediate layer 108 and outer layer 110) substantially surrounding core 106. The cover layer includes at least one dimple 102 and at least one land area 104 adjacent to the dimple 102.

Figure 3A:
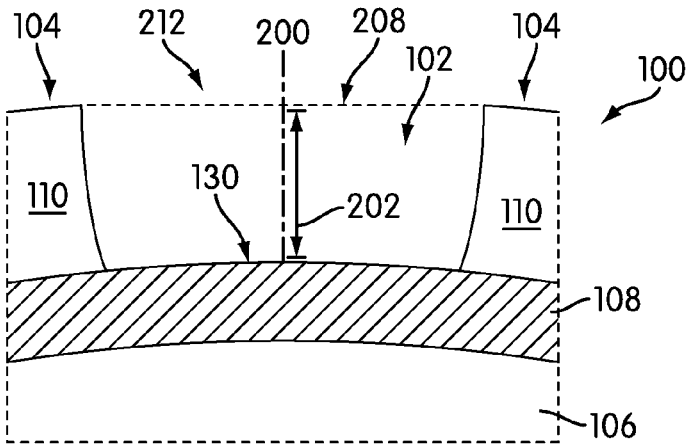
FIG. 3 shows three close-up cross-sectional views of a single dimple on the golf ball of FIG. 1.
Figure 3B:
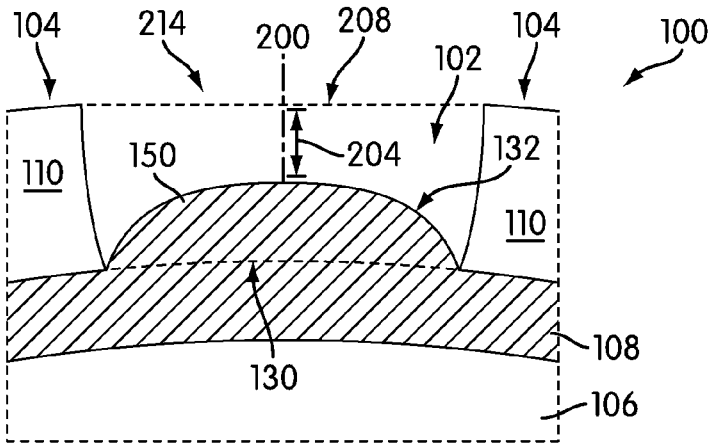
Figure 3C:
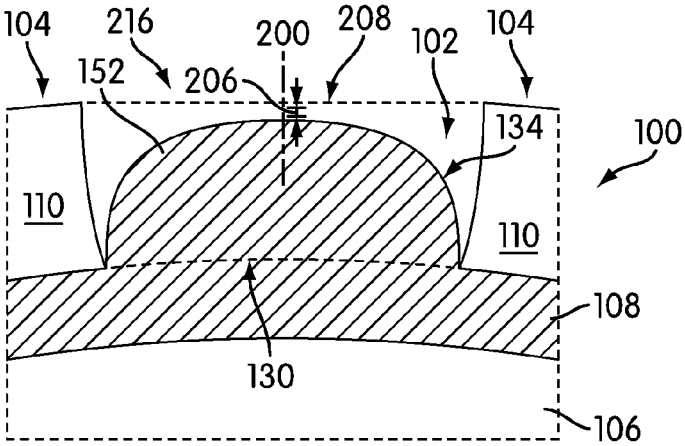

FIG. 3 shows one particular dimple 102 on golf ball 100 in further detail. Dimple 102 exists in the top portion of FIG. 3 in a first configuration 212, as shown. Dimple 102 is defined as the area under line 208, where line 208 is defined by the upper surface of land area 104. Dimple 102 includes a base area 130 defined by the bottom surface of dimple 102 in the first configuration 212. As shown by FIG. 3, outer layer 110 constitutes land area 104 and substantially overlays the entirety of intermediate layer 108 except at the base area 130. In the first configuration 212, dimple 102 includes a first dimple depth 202. First dimple depth 202 as shown is measured at the center 200 of the dimple. However, the phrase "dimple depth" as used in the present disclosure need not necessary be measured at center 200 of dimple 102, but may generally be understood as the distance between the top of the dimple 208 and the bottom surface of the dimple 130 at any given particular point, or (for example) as an average across the entire dimple 102. Furthermore, dimple 102 in first configuration 212 also has a first dimple volume, the dimple volume being the total volume inside dimple 102 under the plane represented by line 208.

As shown in the intermediate portion of FIG. 3, intermediate layer 108 is configured to be capable of changing from first configuration 212 into a second configuration 214. Second configuration 214 is associated with a second dimple depth 204. Generally, second dimple depth 204 may be any dimple depth that is different from first dimple depth 202. However, as shown, second dimple depth 204 is less than first dimple depth 202. In particular, second dimple depth 204 may be about half the distance of first dimple depth 202. Second configuration 214 is also associated with a second dimple volume, which is different from the first dimple volume. In particular embodiments, the second dimple volume is less than the first dimple volume.

The change from first configuration 212 to second configuration 214 generally occurs through a physical change in intermediate layer 108. Intermediate layer 108 is made of a relatively mutable material, which is capable of changing in response to some specifically applied stimulus. In contrast, outer layer 110 is made of a relatively non-mutable material.

Therefore, at least the land area 104 is made of a relatively non-mutable material, while at least the bottom surface 130 of the dimple in first configuration 212 is made of a relatively mutable material. As used herein, the phrases "relatively mutable" and "relatively non-mutable" broadly mean that the former is more mutable than the latter. In specific embodiments, the relatively mutable material changes in some manner in response to one or more desired stimuli, while the relatively non-mutable material does not appreciably change in response to the stimuli.

In some embodiments, the relatively non-mutable material making up layer 110 ensures that the total diameter of golf ball 100 does not change. As is generally known in the art of golf ball construction, the total diameter of a golf ball is measured at the furthest distance between opposite points on the sphere of the golf ball. Therefore, the total diameter of golf ball 100 is the distance between land areas 104 (and therefore also line 208) on opposing sections of the ball. Accordingly, the change from first configuration 212 to second configuration 214 generally may not change the total diameter of golf ball 100. In other embodiments, however, the total diameter of golf ball 100 may change.

In the particular embodiment shown in the intermediate portion of FIG. 3, a portion 150 of intermediate layer 108 expands up and outward into dimple 102. Although FIG. 3 shows portion 150 as being generally hemispherical, portion 150 may generally take any shape. In embodiments other than those shown in FIG. 3, portion 150 may be in the form of a specific desired shape that may affect the aerodynamics of the golf ball in ways other than those related to the dimple depth. Portion 150 extends upward into dimple 102, creating new dimple bottom surface 132. Second dimple depth 204 may therefore be measured as the distance between new dimple bottom surface 132 and line 208 denoting the top of dimple 102. In particular embodiments, second dimple depth 204 may be, for example, approximately half first dimple depth 202. New dimple bottom surface 132 also defines the second dimple volume, as the total volume inside dimple 102 between surface 132 and the plane represented by line 208.

The bottom portion of FIG. 3 shows how dimple 102 may optionally further change to a third configuration 216. Third configuration 216 is associated with a third dimple depth 206. Generally, third dimple depth 206 may be any dimple depth that is different from first dimple depth 202 and second dimple depth 204. In the particular embodiment shown in FIG. 3, third dimple depth 206 is less than second dimple depth 204, which is in turn less than first dimple depth 202. In particular embodiments, dimple depth 206 may be a very small depth that is negligibly different from zero. In third configuration 216, a portion 152 of intermediate layer 108 may expand up into dimple 102 in order to affect the change in dimple depth. Portion 152 creates a new dimple bottom surface 134.

Third configuration 216 is also associated with a third dimple volume. As with third dimple depth 206, the third dimple volume may generally be any dimple volume that is different from the first dimple volume and the second dimple volume. In particular embodiments, as shown in FIG. 3, the third dimple volume is less than the second dimple volume, which in turn is less than the first dimple volume. The third dimple depth is defined as the total volume inside dimple 102 between surface 134 and the plane represented by line 208. In particular embodiments, portion 152 may fill substantially the entirety of dimple 102, leaving third dimple volume to be nearly or negligibly different from zero.

With reference back to FIG. 1, the changes in dimple 102 shown in FIG. 3 may occur with respect to one or more of the plurality of dimples across the entirety of golf ball 100. In certain embodiments, fewer than all of the plurality of dimples may be configured to change from first configuration 212 to second configuration 214, and third configuration 216. For example, a certain subset of the plurality of dimples arranged in a desired pattern may be configured to so change. Such a pattern may be, for example, spherically symmetric or non-spherically symmetric. Certain symmetric patterns of the dimples configured to change may meet United States Golf Association (U.S.G.A.) standards for regulation play golf balls. Specifically, a golf ball may include a pattern of dimples configured to change, such that the pattern of changeable dimples causes the golf ball to meet U.S.G.A. rules Section 7.3 standards for symmetry.

In other embodiments, as shown in FIG. 1, all of the plurality of dimples 102 may be configured to change from first configuration 212 to second configuration 216, and third configuration 216. In other words, all of the dimples 102 on golf ball 100 may have the same first dimple depth 202 prior to any change in intermediate layer 108. Consequently, after a change in intermediate layer 108, all of the dimples 102 may have the same second dimple depth 204, or the same third dimple depth 206. The change in the dimples therefore takes place uniformly across all of the plurality of dimples.

Figure 4:
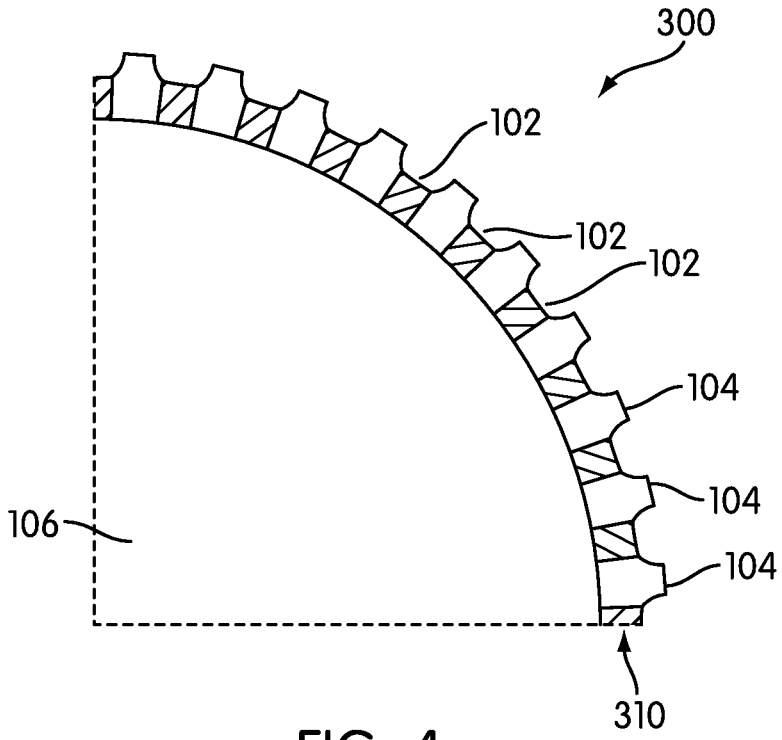
FIG. 4 shows a cross-sectional view of a quarter-turn of an alternative embodiment of a golf ball.

FIG. 4 shows an alternative embodiment of a golf ball 300 in accordance with the present disclosure. As shown in FIG. 4, golf ball 300 includes core 106 and cover layer 310. Cover layer 310 substantially surrounds core 106, includes at least one dimple 102, and includes at least one land area 104 adjacent to the dimple 102.

Figures 5A, 5B:
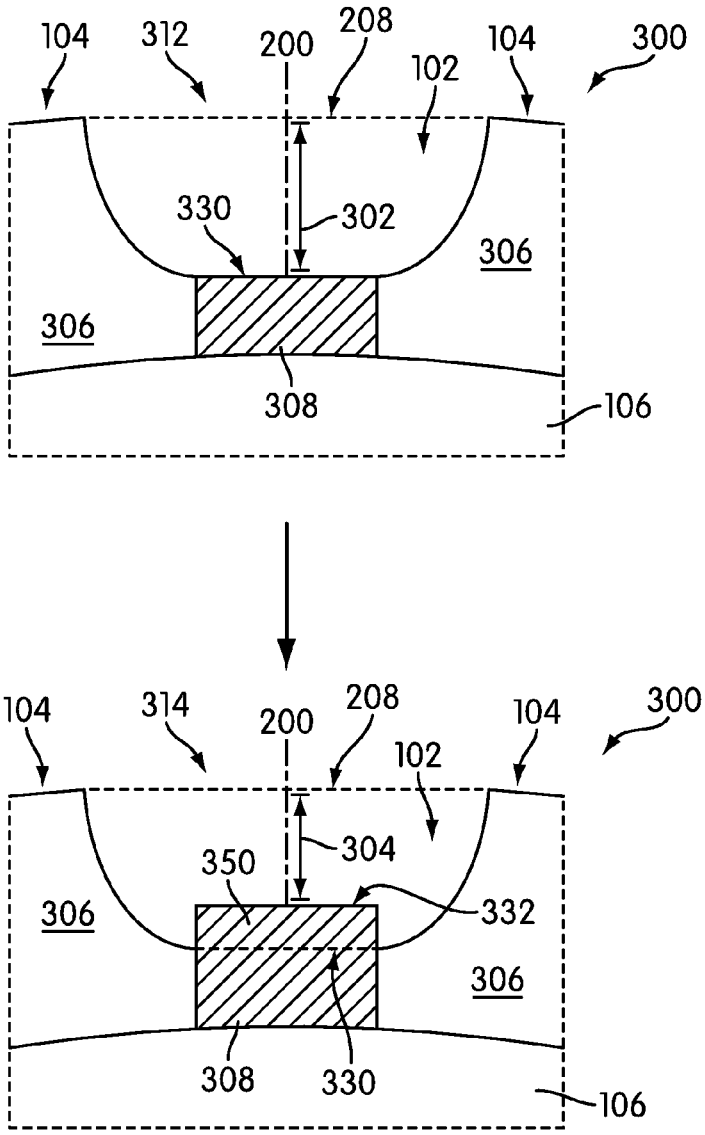
FIG. 5 shows two close-up cross-sectional views of a single dimple on the golf ball of FIG. 4.

FIG. 5 shows a cross-sectional view of one dimple 102 on golf ball 300, in further detail. Dimple 102 has a bottom surface 330 that is comprised of a relatively mutable material 308. Land areas 104 are comprised of a relatively non-mutable material 306. Similar to the embodiment of golf ball 100, discussed above, dimple 102 on golf ball 300 may change from a first configuration 312 to a second configuration 314. First configuration 312 is associated with first dimple depth 302, and a first dimple volume. Second configuration 314 is associated with second dimple depth 304, and a second dimple volume. Therefore, generally, mutable material 308 may change in such a way as to alter the dimple depth and dimple volume. In particular embodiments, second dimple depth 304 is less than first dimple depth 302, and the second dimple volume of dimple 102 on golf ball 300 is less than the first dimple volume thereof.

In the particular embodiment illustrated in FIG. 5, mutable material 308 comprises the entirety of a cross section of cover layer 310 beneath the bottom surface of the dimple 330. In other words, mutable material 308 is configured as a column at the bottom of the dimple, extending from the inner surface of cover layer 310 (where cover layer 310 meets core 106) to the outer surface 330 of cover layer 310. In one embodiment, mutable material 308 may expand linearly outward into dimple 102. This expansion causes portion 350 to bulge up into the original shape of dimple 102, creating new dimple bottom surface 332. In the particular embodiment shown in FIG. 5, portion 350 is a straight column that has expanded only upward from mutable material 308. However, in other embodiments, portion 350 may expand in other directions after expanding upward, causing mutable material to spill over on top of non-mutable portion 306.

The distance between new dimple bottom surface 332 and the top of dimple 102 denoted by line 208 is therefore second dimple depth 304, which may be less than the distance 302 between original dimple bottom surface 330 and line 208.

Figure 6:
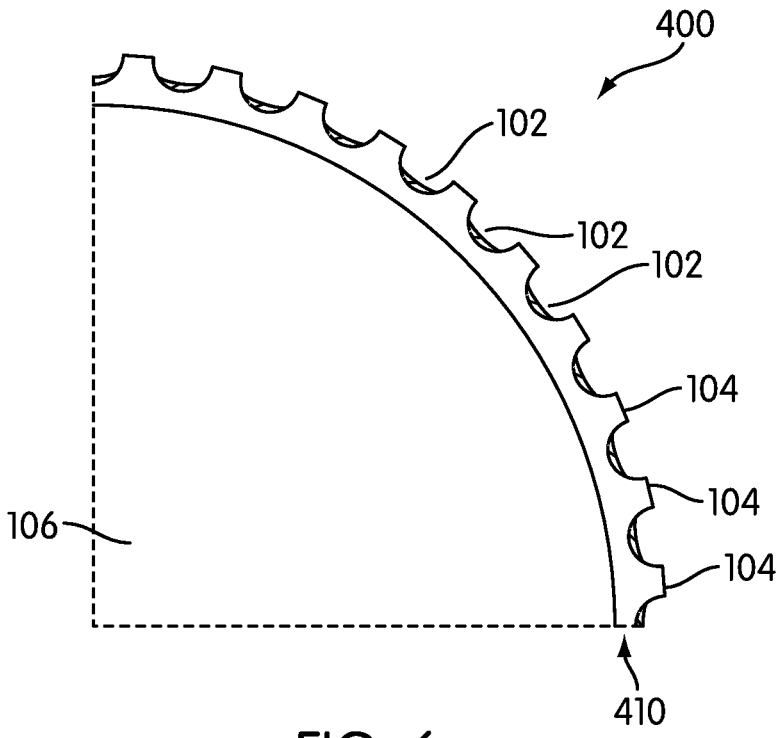
FIG. 6 shows a cross-sectional view of a quarter-turn of a third embodiment of a golf ball.
Figure 7A:
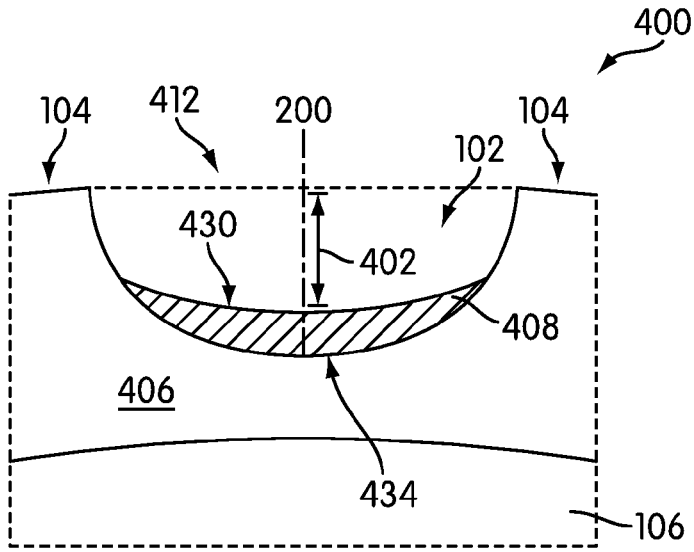
FIG. 7 shows two close-up cross-sectional views of a single dimple on the golf ball of FIG. 6.
Figure 7B:
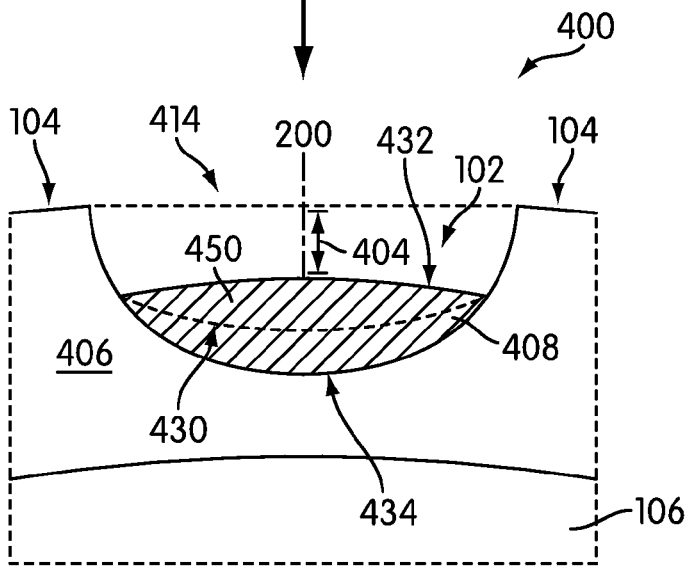

FIGS. 6 and 7 show yet another embodiment of a golf ball 400 in accordance with the present disclosure. Golf ball 400 includes core 106 and cover layer 410 substantially surrounding core 106. As shown in detail in FIG. 7, cover layer 410 is made up of relatively mutable material 408 layered on top of relatively non-mutable material 406. Specifically, relatively mutable material 408 is layered on top of a portion 434 of relatively non-mutable material 406 so that the top surface 430 of relatively mutable material 408 is the bottom surface of dimple 102. Relatively mutable material 408 therefore again forms the bottom surface 430 of dimple 102, and sits on top of relatively non-mutable 406 there underneath.

As shown in FIG. 7, dimple 102 on golf ball 400 may exist in a first configuration 412. First configuration 412 is associated with first dimple depth 402, and first dimple volume. Dimple 102 may then undergo a change into a second configuration 414, as shown in the lower part of FIG. 7. Second configuration 414 is associated with second dimple depth 404, and second dimple volume. Generally, second dimple depth 404 may be any dimple depth that is different from first dimple depth 402. In the particular embodiment shown, second dimple depth 404 is less than first dimple depth 402. Likewise, second dimple volume associated with second configuration 414 may be any dimple volume that is different from the first dimple volume associated with first configuration 412, but in particular may be less than the first dimple volume.

Relatively mutable material 408 may change so as to alter the dimple depth and dimple volume. In particular embodiments, relatively mutable material 408 may expand up into dimple 102 such that a portion 450 of relatively mutable material 408 extends up into a portion of the dimple 102. Portion 450 then has a top surface 432 which may define second dimple height 404.

Figure 8:
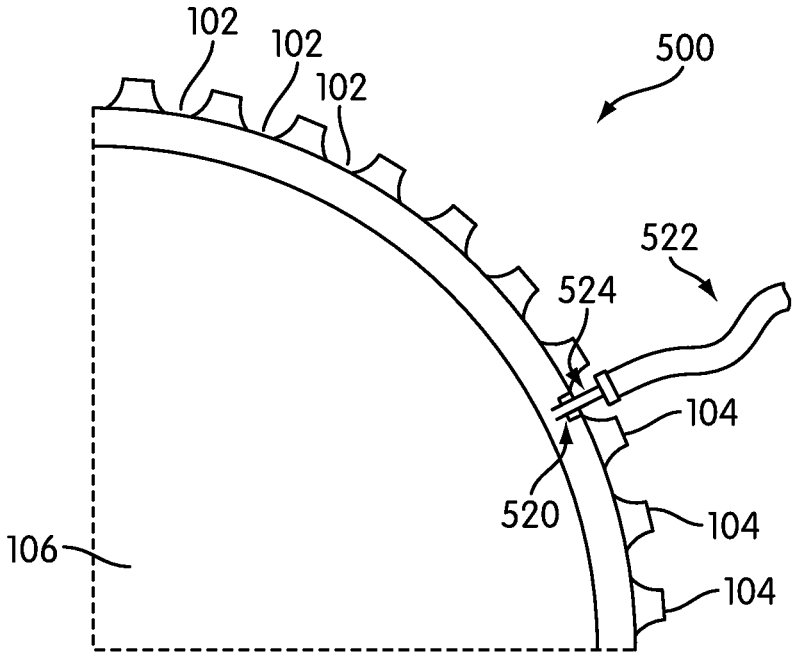
FIG. 8 shows a cross-sectional view of a quarter-turn of a fourth embodiment of a golf ball.
Figure 9A:
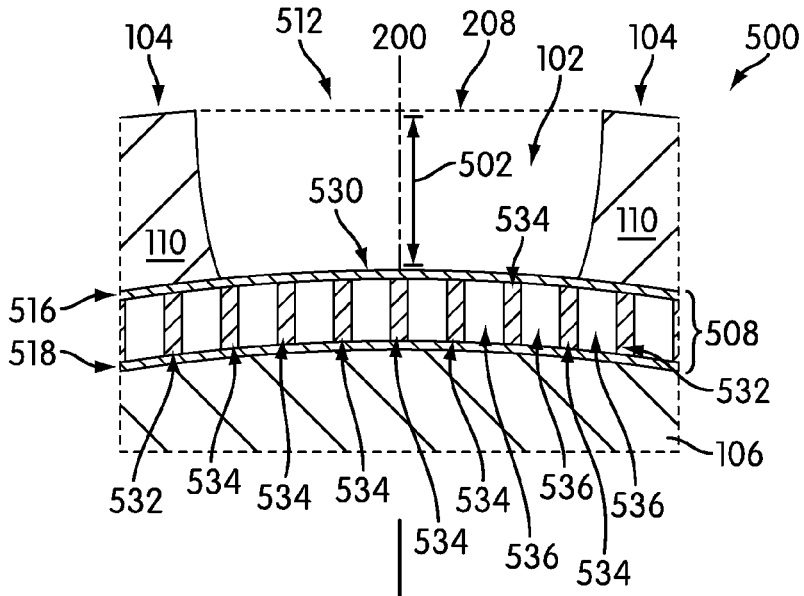
FIG. 9 shows two close-up cross-sectional views of a single dimple on the golf ball of FIG. 8.
Figure 9B:
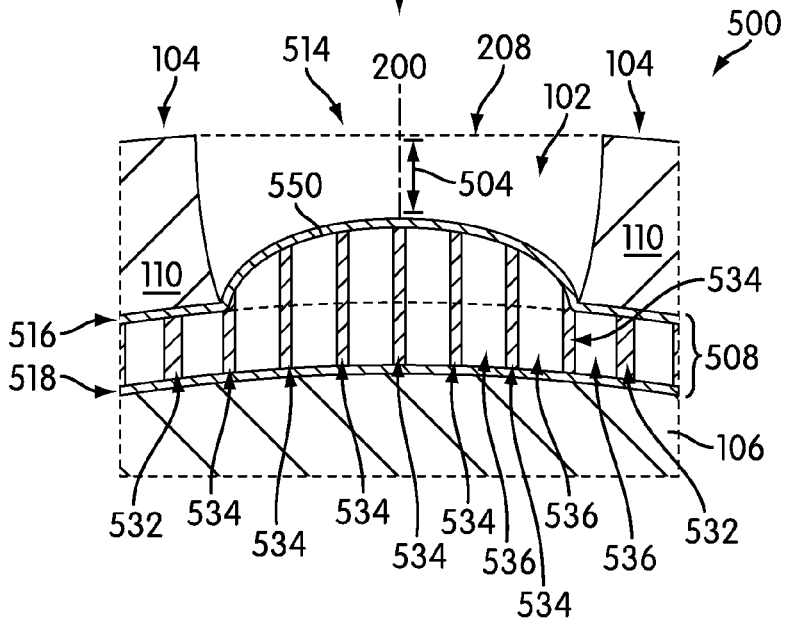

Another embodiment of a golf ball 500 is shown in FIGS. 8 and 9. Golf ball 500 includes a core 106, an intermediate portion 508, and an outer layer 110. Core 106 and outer layer 110 are as discussed above with respect to the embodiment shown in FIGS. 2 and 3. Golf ball 500 further includes a nipple 520, which is configured to be capable of interfacing with a nozzle 524 attached to a hose 522 which is ultimately attached to a pump. Nipple 520 allows for air (or other desired gas) to be introduced into intermediate portion 508.

Specifically, as shown in detail in FIG. 9, intermediate portion 508 may be an inflatable bladder that is located between core 106 and outer layer 110. Outer layer 110 overlays intermediate portion 508 in substantially all areas except at the base area 530 of a dimple 102, where intermediate portion 508 is the outermost structural layer. Intermediate portion 508 includes a top boundary layer 516, a bottom boundary layer 518, and connectors 532 and connectors 534 between top boundary layer 516 and bottom boundary layer 518. Areas 536 are open pockets into which gas may be introduced.

Intermediate portion 508 has a first configuration 512. First configuration 512 is associated with first dimple depth 502, and a first dimple volume. While golf ball 500 is in first configuration 512, open pockets 536 may contain a first amount of gas. The first amount of gas creates a first pressure in the pockets 536. The first pressure is a pressure that is at least sufficient to maintain the structural integrity of golf ball 500 during use in a normal round of golf.

When additional gas is introduced into pockets 536, intermediate portion 508 changes from first configuration 512 into a second configuration 514. Second configuration 514 is associated with a second dimple depth 504, and a second dimple volume. In the specific embodiment shown in FIG. 9, intermediate portion 508 changes into second configuration 514 when sufficient additional gas is introduced into pockets 536 so as to create a second pressure therein. The second pressure should be sufficient to cause top boundary layer 516 to expand upward into dimple 102. When this occurs, certain of the connectors 534 elongate by stretching in order to retain the connection between the bottom boundary layer 518 and the new location of the top boundary layer 516. Other connectors 532 do not stretch, because outer layer 110 overlaps intermediate portion 508 in such a manner that top boundary layer 516 may only expand upward at the bottom surface 530 of dimple 102. When top boundary layer 516 of intermediate portion 508 expands upwards, it creates new bottom surface 550 of dimple 102. Second dimple height 504 is therefore the distance between new bottom surface 550 and line 208.

Each of the different embodiments shown in FIGS. 1-9 includes a mutable material that is configured to change in a manner so as to alter the dimple depth and dimple volume. In the embodiment shown in FIGS. 8 and 9, the mutable material comprises top boundary layer 516, which is part of a flexible inflatable bladder. In such embodiments, the mutable material may be (for example) an elastomer having sufficient flexibility to deform under the second pressure. In other embodiments, the mutable material may be a solid polymeric material. For example, each of intermediate layer 108 in golf ball 100, portion 308 of cover layer 310 on golf ball 300, and portion 408 of cover layer 410 on golf ball 400 may each respectively be made of a continuous polymer material.

The polymer making up the mutable material may generally be any type of polymer that is capable of changing shape in response to some specific stimulus. For example, the polymer may be a thermally expandable polymer. Thermally expandable polymers are discussed, for example, in U.S. Pat. No. 7,549,936, entitled "Golf Ball with Intermediate Layer Containing an Expandable Polymer", and issued on Jun. 23, 2009, the disclosure of which is hereby incorporated in its entirety.

In particular embodiments, the change in the dimple depth or volume may be reversible. In the embodiment shown in FIGS. 8 and 9, the change is reversible merely by changing the gas pressure in pockets 536. However, reversible changes may also be achieved by solid polymeric materials known in the art. Specifically, the category of polymers known as "shape memory polymers" are capable of changing from a first configuration to a second configuration, and back again, upon application of an external stimulus. Shape memory polymers are widely known in the art, and are discussed, for example, in U.S. Pat. No. 7,484,735, entitled "Reversible Thermally Expandable and/or Contractible Seal Assemblies", and issued on Feb. 3, 2009, the disclosure of which is hereby incorporated in its entirety.

Accordingly, the present disclosure also provides a method of customizing a golf ball. Generally, the method of customizing a golf ball includes (1) possessing a golf ball that is configured in accordance with any of the above discussed golf balls, and (2) inducing the mutable portion of the golf ball to change from a first configuration associated with a first dimple depth into a second configuration associated with a second dimple depth. The method of customizing a golf ball is a post-manufacturing step, which can easily be performed by (for example) a consumer end-user golfer without the use of industrial equipment. The method may therefore be practiced by an amateur golfer him or herself, or may be performed by a golf pro-shop employee on behalf of the golfer.

Figure 10A:
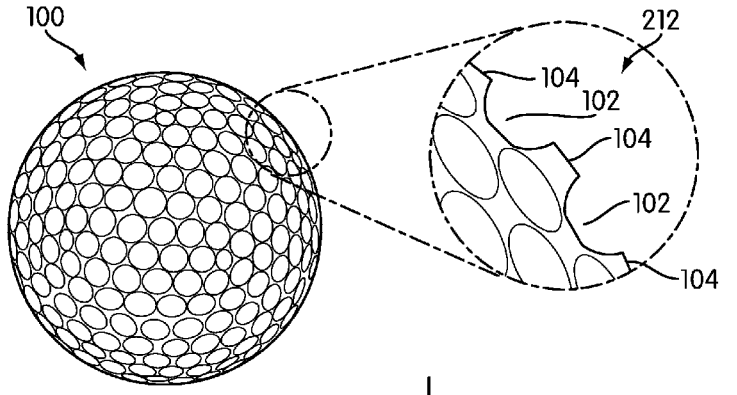
FIG. 10 shows a method of customizing a golf ball, by heating the golf ball in a microwave.
Figure 10B:
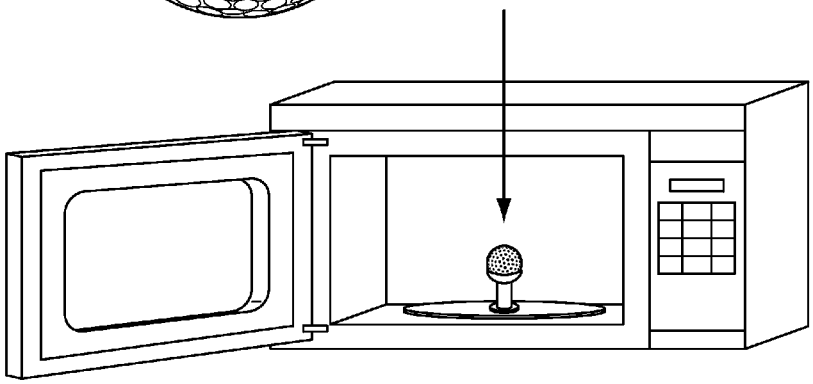
Figure 10C:
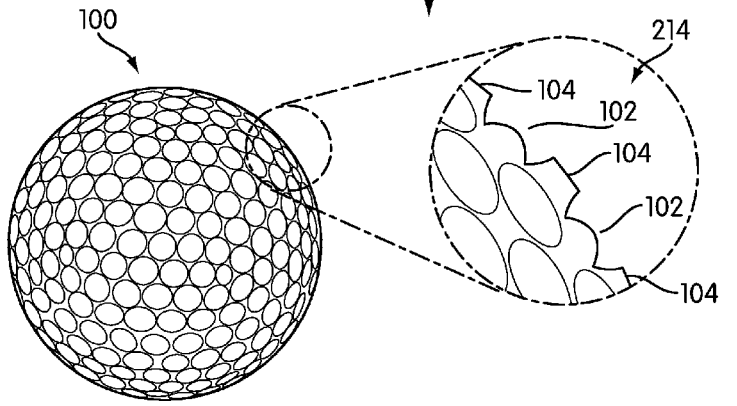

FIG. 10 shows one embodiment of a method of customizing a golf ball. Generally, in one embodiment, the step of inducing the mutable portion of the golf ball to change may constitute applying heat to the golf ball. Heat may be applied by, for example: radiation, conduction, convection in a gas, convection in a liquid, or other known heating methods. Specifically, golf ball 100 may be subjected to heating in a microwave. Namely, first, golf ball 100 exists in first configuration 212 associated with first dimple depth 202. Next, golf ball 100 is subject to heating in a microwave for a predetermined desired time period. After the predetermined time period, golf ball 100 achieves second configuration 214 associated with second dimple depth 204.

The predetermined time period for heating may vary depending on the desired temperature necessary to affect a change, which in turn depends on the exact chemical composition of the mutable material in the golf ball. For example, in an embodiment where intermediate layer 108 is a shape memory polymer as detailed in U.S. Pat. No. 7,484,735, a preferred temperature for inducing a change is less than or equal to about 180° C. For convenience to a consumer golfer, the temperature necessary to affect a change in the mutable material should generally be high enough that no change takes place even under warm environmental conditions (for example, not below about 50° C.), so as to avoid inducing a change when no change is desired. Furthermore, also for convenience to golfers, the temperature should not be so high as to require any special energy-intensive heating equipment. Temperatures of less than about 200° C. may be achieved without undue difficulty by, for example, a home microwave or oven.

Another method of applying heat to golf ball 100 may be the use of a handheld heating device. A handheld golf ball heating device is fully described in U.S. Pat. No. 8,283,603, currently U.S. patent application Ser. No. 12/604,830, entitled Device for Heating a Golf Ball, and filed on Oct. 23, 2009, the disclosure of which is hereby incorporated in its entirety.

Figure 11A:
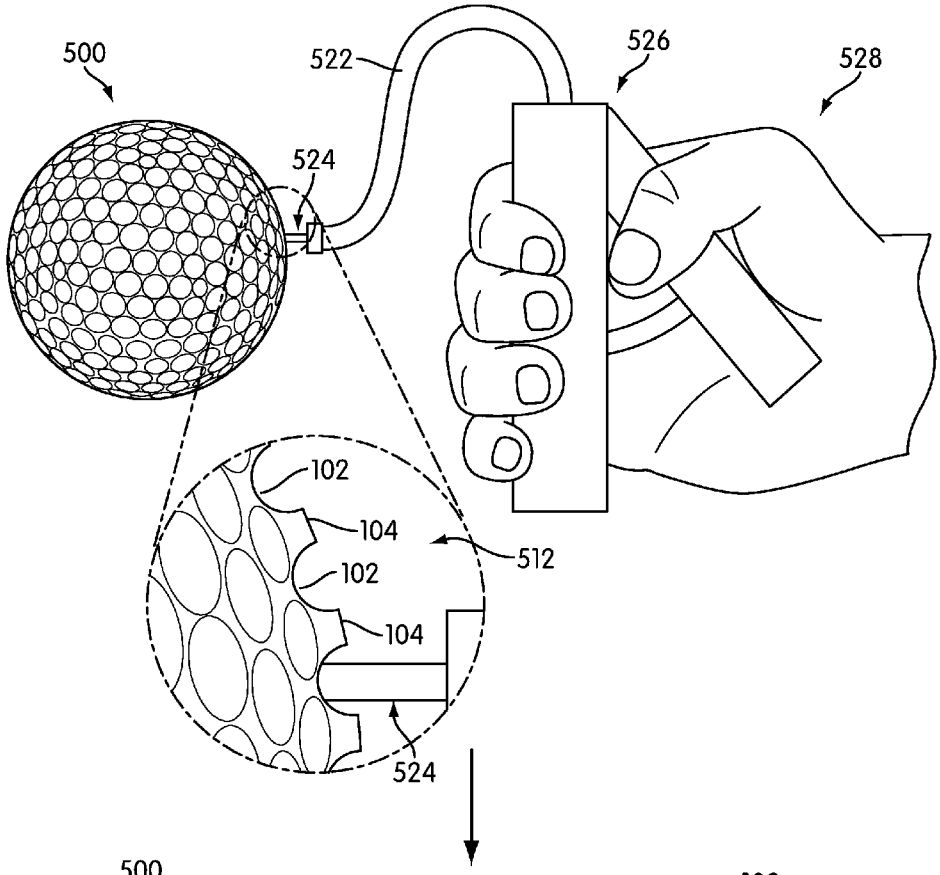
FIG. 11 shows a method of customizing a golf ball, by inflating a component of the golf ball with a handheld pump.
Figure 11B:
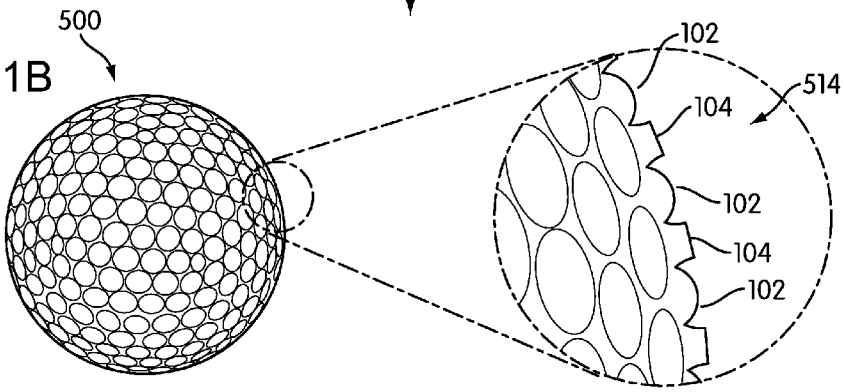

FIG. 11 shows an alternative embodiment of the method. As was discussed with respect to FIGS. 8 and 9, golf ball 500 may include intermediate portion 508 that changes configuration in response to a change in internal gas pressure. Golf ball 500 therefore, first, exists in first configuration 512 associated with first dimple depth 502. The gas pressure in pockets 536 may then be increased by introducing additional gas into pockets 536 through nipple 520. Specifically, a golfer may use a hand 528 held pump 526, having hose 522 and nozzle 524, to introduce additional gas. The additional gas may be air, sucked into the pump 526 from the atmosphere. Alternatively, for example, the additional gas may be a desired inert gas contained in a reservoir (not shown) in the pump 526. One or more golf ball(s) 500 may be sold in a kit along with pump 526 and one or more such reservoirs. As a result of the increased gas introduced by pump 526, the internal pressure in pockets 536 increases, causing golf ball 500 to achieve second configuration 514 associated with second dimple depth 504.

Although several embodiments of external stimuli, such as heating or changing gas pressure, are discussed above, the method of the present disclosure may generally include any external stimulus that can affect a change in the mutable material. For example, external stimuli such as radiating (even without heating), wetting, physical pressure, or exposure to a specific chemical composition are all methods of inducing a change in a polymeric material that may be used in the present method.

Figure 12:
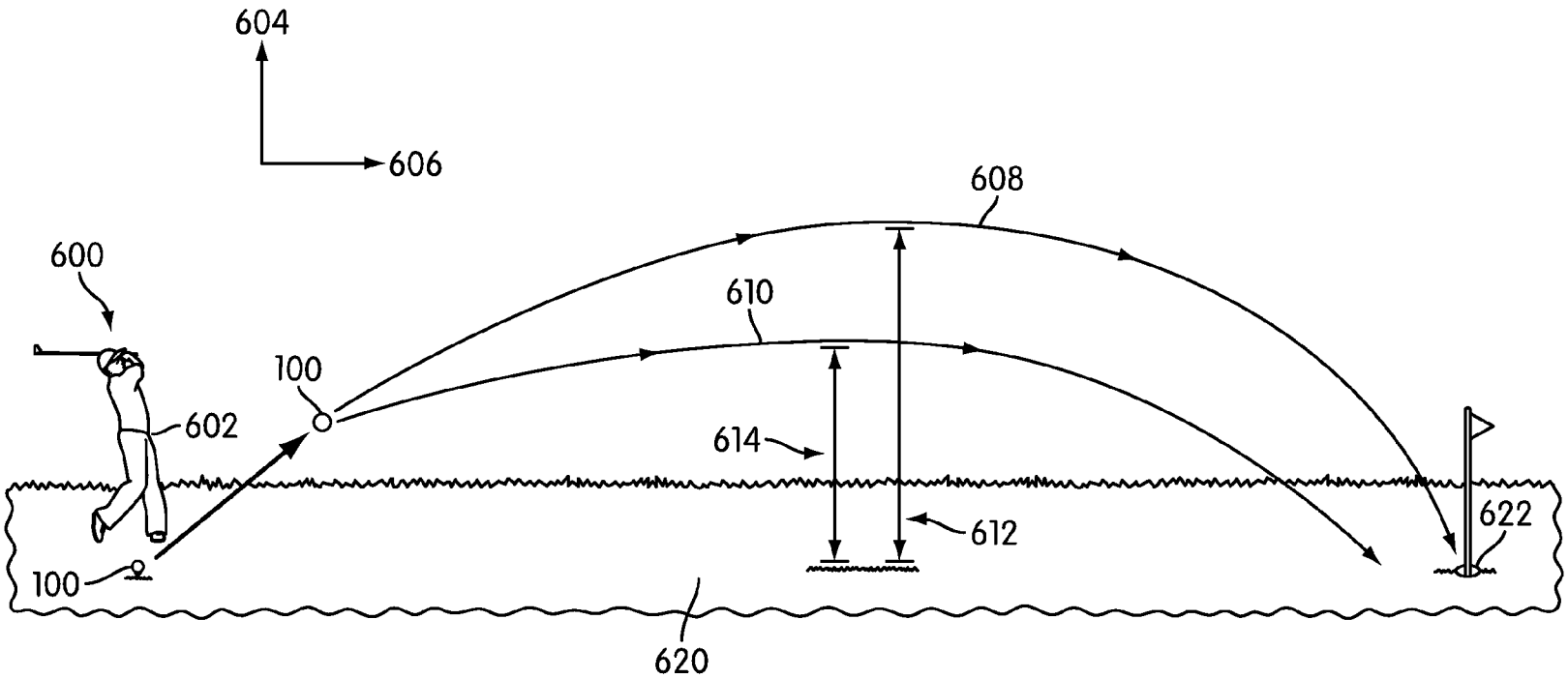
FIG. 12 shows two alternative flight paths of two golf balls, after being hit by a golf club swung by a golfer.

Finally, FIG. 12 shows how the change in dimple depth affects the play characteristics of the golf ball. As was discussed above, a golf ball having shallow dimples will generally experience increased loft, and so fly along a higher flight path. On the other hand, a golf ball having deeper dimples will generally fly along a lower flight path. Golfer 602 may therefore customize the flight path golf ball 100 takes, all other factors being equal. Specifically, when golf ball 100 is in first configuration 212, golf ball 100 will generally take a first flight path 608 after being stuck by golf club 600 under generally dry conditions and with a typical swing speed not exceeding 100 mph. First flight path 608 will generally achieve increased vertical distance 612 at its peak, and slightly increased horizontal distance 606. First flight path 608 is generally symmetrical about its peak, the shifted peak shown in FIG. 12 is exaggerated for clarity.

On the other hand, when golf ball 100 is in second configuration 214, it will generally take second flight path 610, assuming the same conditions as first flight path 608. Second flight path 610 will generally achieve a lower vertical distance 614 at its peak, and very slightly less horizontal distance 606. Golfer 602 may therefore choose which configuration is most advantageous to the specific conditions under which the round of golf is being played.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A golf ball comprising:

a core;

an intermediate layer substantially surrounding the core; and an outer layer, the outer layer including a plurality of dimples and at least one land area separating the dimples, each of the plurality of dimples including a base area defined by a bottom surface of the dimple;

wherein the outer layer substantially surrounds the intermediate layer, such that the outer layer overlays the entirety of the intermediate layer except at the base area of each of the plurality of dimples;

wherein the intermediate layer is configured to be capable of changing from a first configuration to a second configuration within the golf ball in a finished state;

wherein the first configuration is associated with a first dimple depth, the second configuration is associated with a second dimple depth, the second dimple depth being different from the first dimple depth; and the first dimple depth causes the finished golf ball to exhibit first play characteristics, the second dimple depth causes the finished golf ball to exhibit second play characteristics, and the second play characteristics are different from the first play characteristics.

2. The golf ball according to claim 1, wherein the first configuration is associated with a first dimple volume, the second configuration is associated with a second dimple volume, and the second dimple volume is different from the first dimple volume.

3. The golf ball according to claim 1, wherein the intermediate layer changes from the first configuration to the second configuration by expanding so as to cause a portion of the intermediate layer to extend into the plurality of dimples.

4. The golf ball according to claim 1, wherein the intermediate layer is configured such that the change from the first configuration to the second configuration is reversible.

5. The golf ball according to claim 1, wherein the intermediate layer is configured to be capable of changing from the second configuration to a third configuration;

the third configuration being associated with a third dimple depth; and wherein the third dimple depth is different from the second dimple depth and the first dimple depth.

6. The golf ball according to claim 5, wherein the third dimple depth is about zero.

7. The golf ball according to claim 1, wherein all of the plurality of dimples have the same first dimple depth, and all of the plurality of dimples have the same second dimple depth.

8. The golf ball according to claim 1, wherein fewer than all of the plurality of dimples are configured to change from the first configuration to the second configuration.

9. The golf ball according to claim 1, wherein the intermediate layer comprises an expandable polymer.

10. The golf ball according to claim 1, wherein the intermediate layer comprises an inflatable bladder.

11. A golf ball comprising:

a core;

a cover layer substantially surrounding the core;

the cover layer including at least one dimple having a dimple volume, and at least one land area adjacent to the dimple;

wherein at least the land area is comprised of a relatively non-mutable material, and at least a bottom surface of the dimple is comprised of a relatively mutable material; and wherein a physical change in the relatively mutable material alters the dimple volume;

wherein the relatively mutable material comprises an entirety of a cross section of the cover layer beneath the bottom surface of the dimple; and the alteration in the dimple volume changes one or more play characteristics of the golf ball.

12. The golf ball of claim 11, wherein the dimple has a dimple depth, and the physical change in the relatively mutable material alters the dimple depth.

13. The golf ball of claim 11, wherein the change in the relatively mutable material decreases the dimple volume.

14. The golf ball of claim 13, wherein the relatively mutable material is configured so as to expand in such manner that a portion of the relatively mutable material extends outward into the dimple.

15. The golf ball of claim 11, wherein the relatively mutable material is configured such that the change in the relatively mutable material is reversible.

16. The golf ball of claim 11, wherein the relatively mutable material comprises an expandable polymer.

17. A method of customizing a golf ball, the method comprising:

(1) possessing a finished golf ball, the finished golf ball including a core, and a cover layer substantially surrounding the core;

the cover layer including a plurality of dimples and at least one land area separating the dimples;

the cover layer further including a mutable portion configured in a first configuration, the first configuration being associated with a first dimple depth; and (2) inducing the mutable portion to change from the first configuration into a second configuration, the second configuration being associated with a second dimple depth, wherein the second dimple depth is different from the first dimple depth;

wherein the mutable portion comprises an inflatable bladder;

the step of inducing the mutable portion to change from the first configuration into the second configuration comprises inflating the inflatable bladder; and the first dimple depth causes the finished golf ball to exhibit first play characteristics, the second dimple depth causes the finished golf ball to exhibit second play characteristics, and the second play characteristics are different from the first play characteristics.

18. The method of claim 17, wherein the step of inducing the mutable portion to change from the first configuration into the second configuration is a post-manufacturing step.

19. The method of claim 17, wherein the step of inducing the mutable portion to change from the first configuration into the second configuration comprises applying heat to the golf ball.

20. A golf ball comprising:

a core;

a cover layer substantially surrounding the core;

the cover layer including at least one dimple having a dimple volume, and at least one land area adjacent to the dimple;

wherein at least the land area is comprised of a relatively non-mutable material, and at least a bottom surface of the dimple is comprised of a relatively mutable material; and wherein a physical change in the relatively mutable material alters the dimple volume, from a first dimple volume to a second dimple volume;

the first dimple volume causes the finished golf ball to exhibit first play characteristics, the second dimple volume causes the finished golf ball to exhibit second play characteristics, and the second play characteristics are different from the first play characteristics; and wherein the relatively mutable material at the bottom surface of the dimple is layered on top of a portion of the relatively non-mutable material.

21. The golf ball of claim 1, wherein the second dimple depth is about half of the first dimple depth.

* * * * *